US005921813A

United States Patent [19]

Patel et al.

[11] Patent Number: 5,921,813

[45] Date of Patent: Jul. 13, 1999

[54] ELECTRICAL CONNECTOR WITH LATCH

[75] Inventors: Arvind Patel, Naperville; Jack J. Schafer, LaGrange, both of Ill.

[73] Assignee: Molex Incorporated, Lisle, Ill.

[21] Appl. No.: 08/906,695

[22] Filed: Aug. 6, 1997

[51] Int. Cl.[6] ..... H01R 13/73

[52] U.S. Cl. ..... 439/571

[58] Field of Search ..... 439/571, 350, 439/357

[56] References Cited

U.S. PATENT DOCUMENTS

| | | | |
|---|---|---|---|
| 3,179,738 | 4/1965 | DeLyon | 174/50 |
| 3,926,497 | 12/1975 | Eigenbrode | 339/91 |
| 4,150,867 | 4/1979 | Knickerbocker | 339/97 |
| 5,011,424 | 4/1991 | Simmons | 439/352 |
| 5,354,216 | 10/1994 | Cruise et al. | 439/553 |

*Primary Examiner*—Gary Paumen
*Assistant Examiner*—Briggitte R. Hammond
*Attorney, Agent, or Firm*—Stephen Z. Weiss

[57] ABSTRACT

An electrical connector includes a dielectric housing adapted for mounting on a complementary support structure in a given mounting direction. The housing has opposite side walls. A latch arm is cantilevered from each side wall of the housing and extends forwardly in the mounting direction. Each latch arm has a latch hook near a free end of the arm. The latch hook projects transversely of the mounting direction inwardly toward the respective side wall of the housing. The side walls include inwardly recessed areas into which the latch hooks extend.

6 Claims, 4 Drawing Sheets

ELECTRICAL CONNECTOR WITH LATCH

FIELD OF THE INVENTION

This invention generally relates to the art of electrical connectors and, particularly, to an improved latching system for latching an electrical connector to a complementary mating connector or other mounting structure.

BACKGROUND OF THE INVENTION

Very generally, an electrical connector typically includes a dielectric housing mounting a plurality of conductive terminals for electrical interconnection with the terminals or contacts of another electrical connecting device. In many instances, it is desirable to provide a latch means for latching the connector to the other connecting device which may be a complementary mating connector, or a mounting panel or a variety of other complementary structures to which the connector is mounted and to which it is desirable to lock or latch the connector.

One type of latching mechanism is a flexible latch arm which typically extends in the direction in which the connector is mounted to the complementary mounting structure. The latch arm usually is a cantilevered arm with a latch hook on a distal end thereof for latching behind a latch surface on the complementary mounting structure. Quite often, the latch arm is cantilevered from one side wall of the connector housing, such that the latch arm flexes transversely of the mounting direction of the connector. The latch hook on the latch arm has a rearwardly facing latching surface for engaging a complementary latching surface on the mounting structure. It is desirable to have as large a latching surface as possible to ensure that the latch hook is not easily, unintentionally disengaged. On the other hand, increasing the size of the latching surface causes the cantilevered latch arm to project laterally too far away from the connector housing when space requirements often are important in electrical connector design. The present invention is directed to solving this problem by providing a unique structural arrangement wherein the latching surface of the latch hook on the cantilevered latch arm can be significantly increased without in any way increasing the overall size of the connector.

SUMMARY OF THE INVENTION

An object, therefore, of the invention is to provide an electrical connector with a new and improved latching system.

In the exemplary embodiment of the invention, the connector includes a dielectric housing adapted for mounting on a complementary structure in a given mounting direction. The housing has opposite side walls. A latch arm is cantilevered from each side wall of the housing and extends forwardly in the mounting direction. Each latch arm has a latch hook near a free end of the arm. The latch hook projects transversely of the mounting direction, inwardly toward the respective side wall of the housing. The side walls include inwardly recessed areas into which the latch hooks extend. In essence, the recessed areas allow the latch hooks to be enlarged without in any way enlarging the overall dimensions of the connector housing.

Another feature of the invention is in the design of rearwardly facing latching surfaces on the latch hooks. Preferably, the latching surfaces are angled in a rearward/inward direction to increase the resistance forces on the latching surfaces, to resist moving the latch hooks off of respective latching surfaces on the connector housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
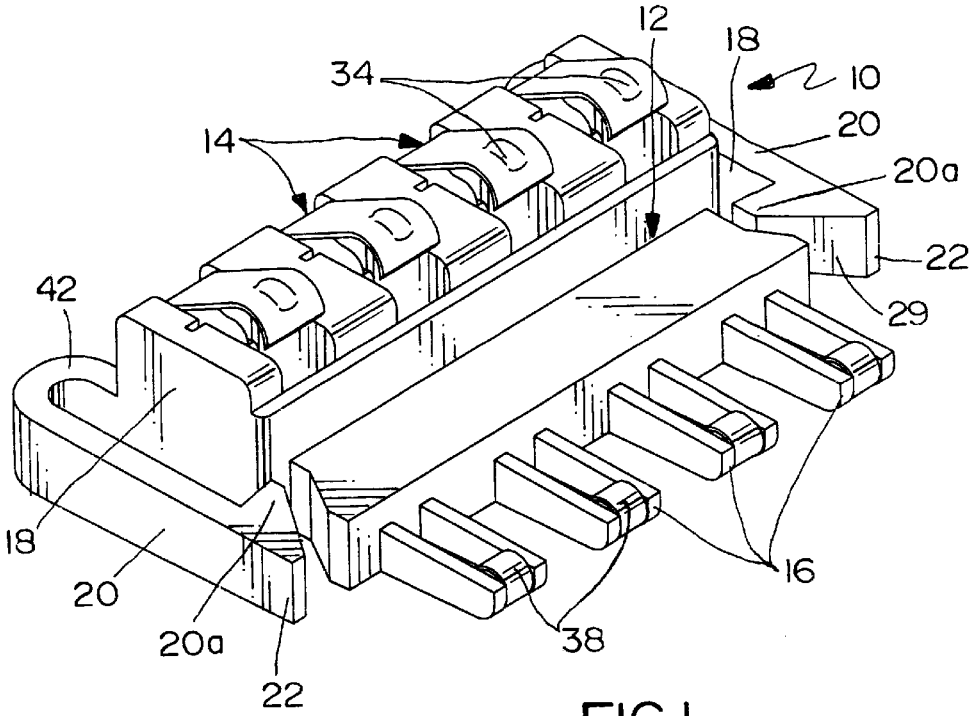
FIG. 1 is a perspective view of an electrical connector embodying the concepts of the invention.

Referring to the drawings in greater detail, and first to FIG. 1, the invention is embodied in an electrical connector, generally designated 10, which includes a one-piece housing, generally designated 12. The housing is unitarily molded of dielectric material such as plastic or the like. The housing mounts a plurality of terminals, generally designated 14. The housing has a plurality of forwardly projecting terminal-support portions 16, along with opposite side walls 18. A flexible latch arm 20 is cantilevered from each side wall 18. Each latch arm has an inwardly directed latch hook **20*a* near a free end 22** of the arm.

Figure 2:
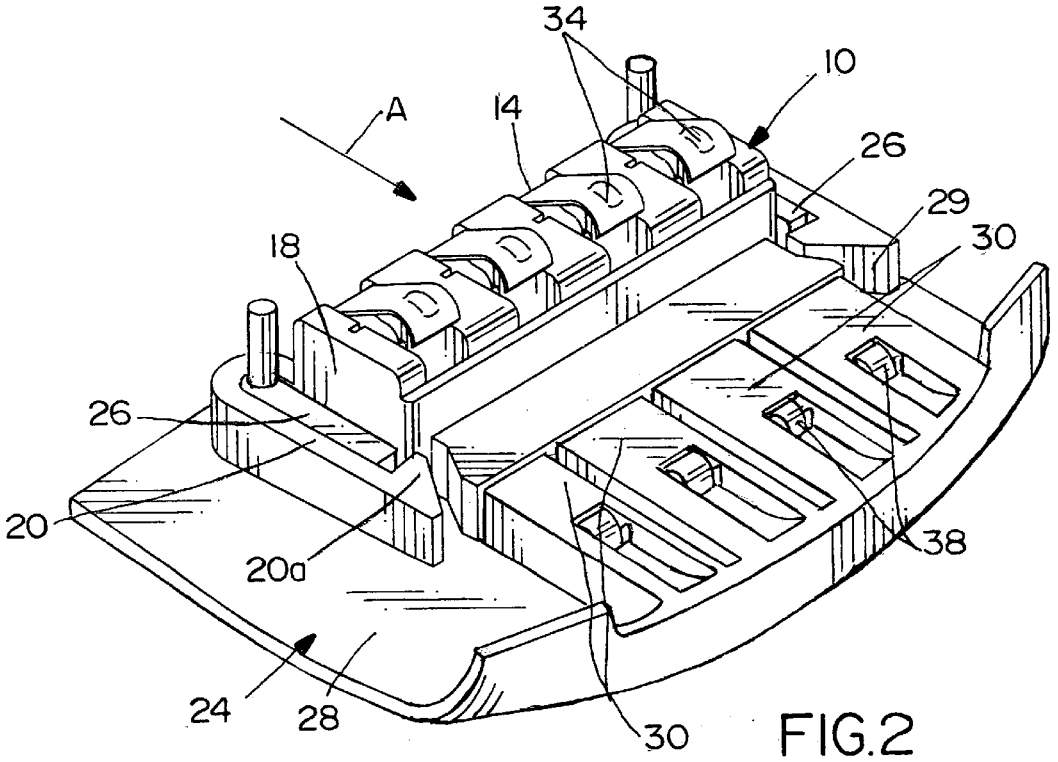
FIG. 2 is a perspective view of the connector mounted on a complementary mounting structure.
Figure 3:
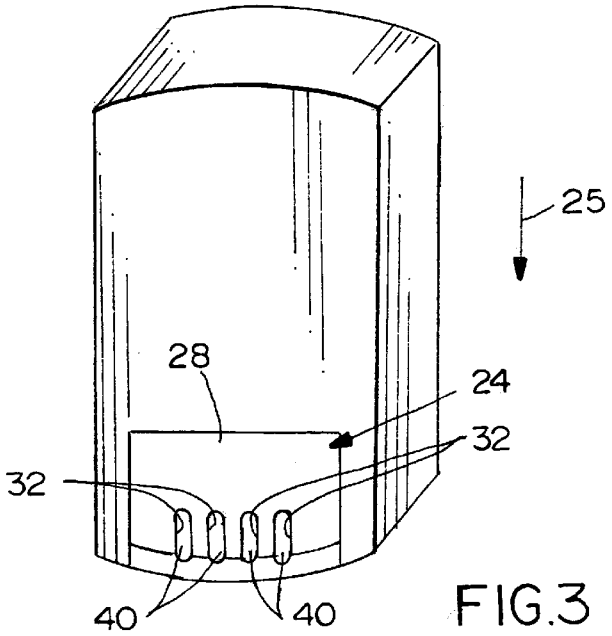
FIG. 3 is a bottom plan view of the mounting structure of FIG. 2 as installed in the rear of a mobile telephone handset.
Figure 4:
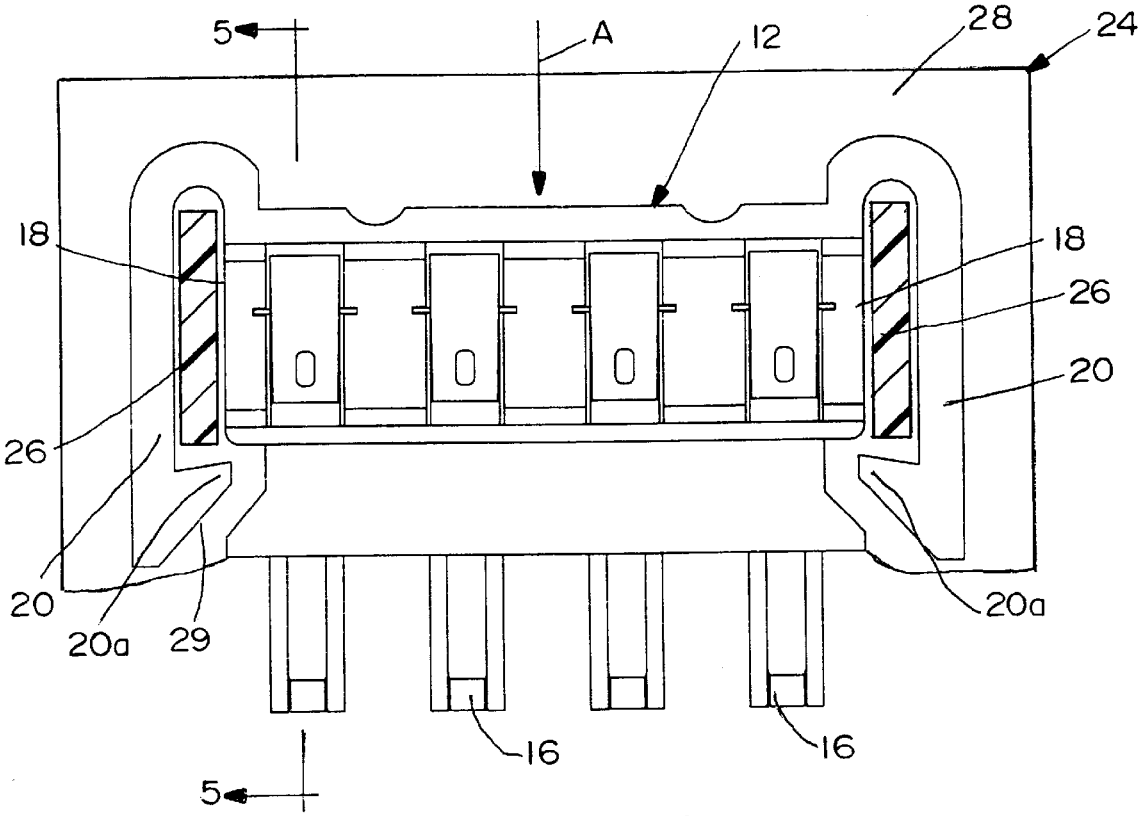
FIG. 4 is a top plan view of the connector, in association with mounting portions of the mounting structure.

Referring to FIGS. 2–4 in conjunction with FIG. 1, electrical connector 10, particularly housing 12, is adapted for mounting on a complementary support structure, generally designated 24. In the particular application shown herein, connector 10 and complementary mounting structure 24 comprise a modular unit which is mounted in a mobile telephone handset 25, such as at the rear of the handset. The connector is mounted to the support structure in the direction of arrows "A" (FIGS. 2 and 4). During mounting, latch hooks **20*a* of latch arms 20 snap behind a pair of walls 26 which are upstanding from a base plate 28 of the mounting structure. The latch arms are biased apart by angled leading edges 29 engaging the rear edges of walls 26. During mounting, forwardly projecting terminal-support portions 16 (FIG. 1) are inserted into a plurality of receptacles 30 of the support structure preventing the connector 10 from pulling away from the support structure. As seen in FIG. 3, base plate 28 of support structure 24 has a plurality of holes 32 in alignment with receptacles 30**, for purposes described below.

Figure 5:
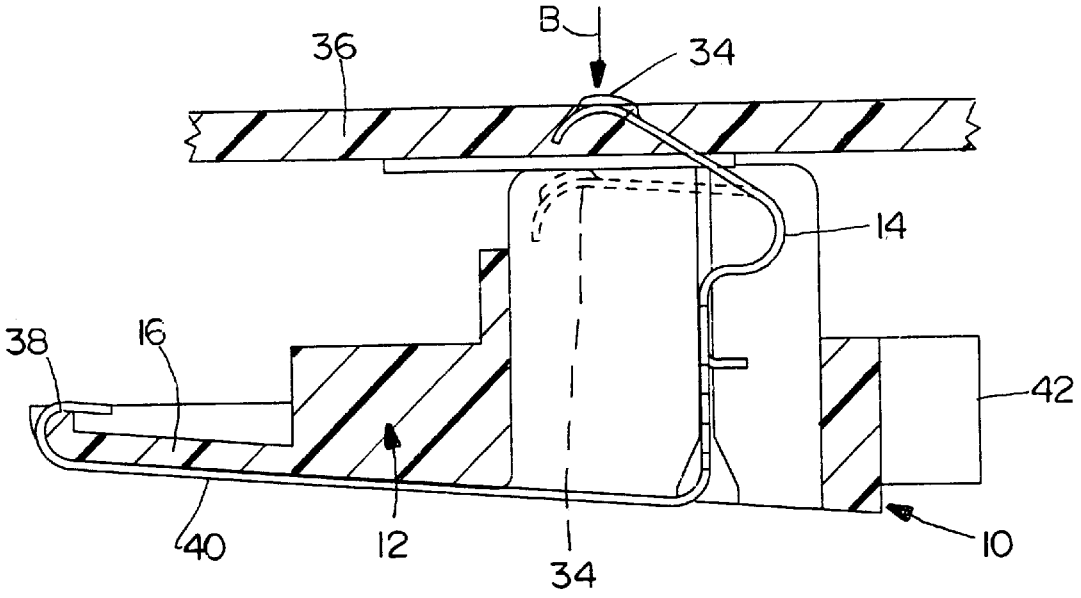
FIG. 5 is a vertical section taken generally along line 5—5 of FIG. 4, with the mounting structure removed but showing a printed circuit board in engagement with the terminals of the connector.

Referring to FIG. 5, each terminal 14 includes an upwardly projecting contact portion 34 for engaging appropriate circuit traces on a printed circuit board 36. The contact portions project upwardly from housing 12 beyond sidewalls 18 as best seen in FIG. 1. The contact portions are flexible and are biased downwardly in the direction of arrow "B" (FIG. 5) in response to engagement with printed circuit board 36. Each contact is stamped and formed of sheet metal material and is wrapped around the bottom of housing 12 as best seen in FIG. 5, and a forward distal end 38 of each terminal is wrapped around the front portion of a respective one of the terminal-support portions 16 to secure the terminal to the housing.

Still referring to FIG. 5, when each terminal 14 is mounted to the housing as described above, a bottom arm 40 of each terminal is disposed on the outside of housing 12 at the bottom thereof. Referring back to FIG. 3, when connector 10 is mounted in support structure 24, bottom arms 40 of terminals 14 are exposed through holes 32 in base plate 28 of the support structure. Therefore, bottom arms 40 of the terminals form battery contacts for the telephone handset. In other words, the handset can be charged by inserting the handset into an appropriate base unit (not shown) which has charging terminals engageable with battery contacts 40 through holes 32. Terminals 14, thereby, interconnect the battery charging terminals to the circuit traces on printed circuit board 36.

Figure 6:
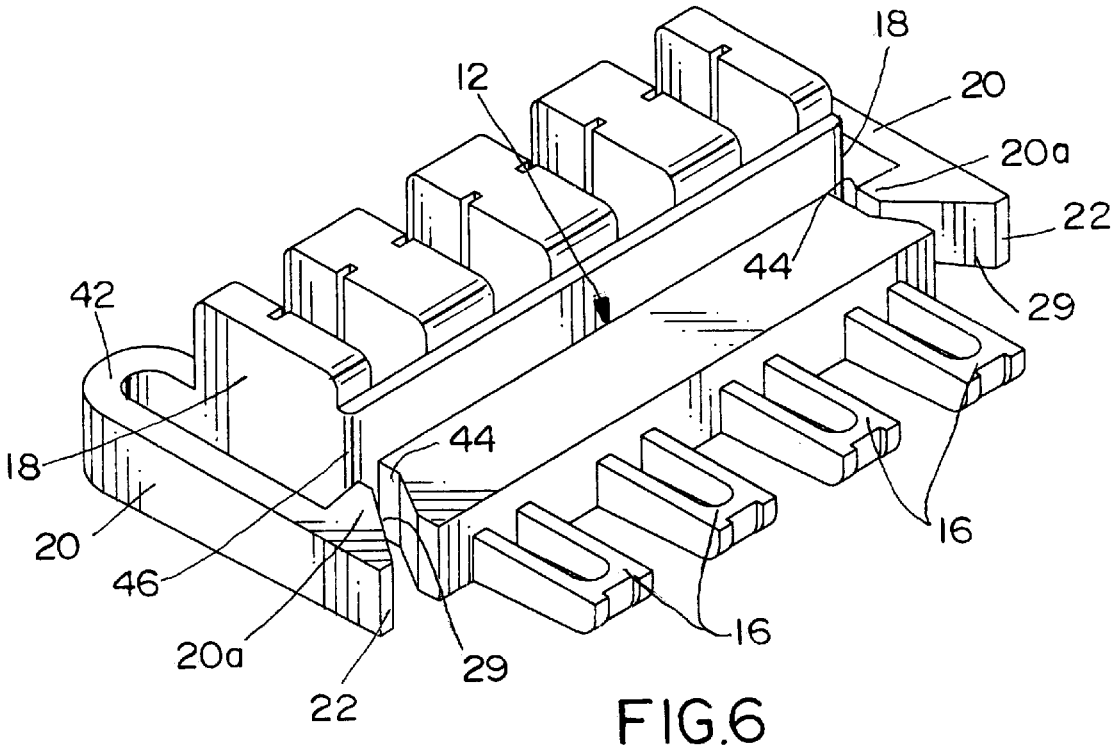
FIG. 6 is a perspective view of the connector housing.
Figure 7:
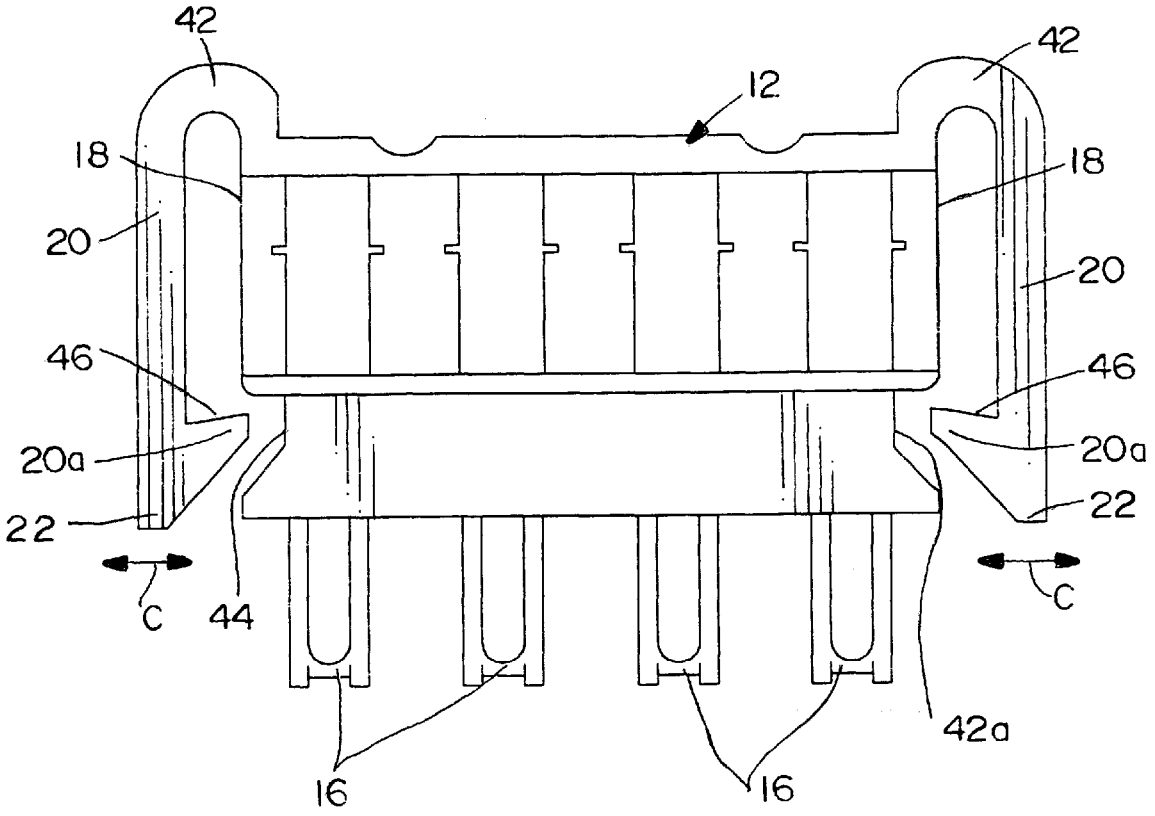
FIG. 7 is a top plan view of the connector housing.

Referring to FIGS. 6 and 7 in conjunction with FIG. 4, latch arms 20 are cantilevered from housing 12 by molding the latch arms integral with the housing. The latch arms thereby have fixed ends 42 along with free ends 22. Therefore, the free ends, along with latch hooks 20*a*, flex with the latch arms in the direction of double-headed arrows "C" (FIG. 7). The latch hooks project transversely of mounting direction "A" (FIG. 4) inwardly toward the respective side wall 18 of the housing.

The invention contemplates that side walls 18 of connector housing 12 include inwardly recessed areas 44 transversely aligned with latch hooks 20*a* and into which the latch hooks extend in their unstressed or latched condition. The recessed areas allow the latch hooks to be made larger without enlarging the overall dimensions of the connector. The larger latch hooks results in a longer latching surface. By providing a longer latching surface the latch arm 20 would have to bend a greater distance than normal, therefore insuring that the housing 12 does not easily become unintentionally disengaged from the support structure 24. It can be seen in FIG. 4 that upstanding walls 26 of support structure 24 actually are completely surrounded by side walls 18, latch arms 20 and latch hooks 20*a*.

Another feature of the invention is best shown in FIG. 7 and concerns the configuration of the rearwardly facing latching surfaces 46 on latch hooks 20*a* which engage the front edges of walls 26 of support structure 24. Specifically, rearwardly facing latching surfaces 46 are angled in a rearward-inward direction, as can be seen clearly in FIG. 7. Because of this angled configuration, if attempts are made to pull connector 10 away from support structure 24 in a direction opposite the mounting direction of arrow "A", the force vectors created by the angled latching surfaces will cause the latch hooks to seat tighter against the front of upstanding walls 26 of the support structure rather than sliding off of the upstanding walls.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector, comprising:

a dielectric housing adapted for mounting on a complementary support structure in a given mounting direction, the housing having opposite side walls;

a latch arm cantilevered and located a given distance from each side wall of the housing and extending forwardly in said mounting direction, each latch arm having a latch hook near a free end of the arm, the latch hook projecting transversely of said mounting direction inwardly toward the respective side wall of the housing;

each latch arm, latch hook and respective side wall defining an opening adapted to receive and hold a portion of the complementary support structure between the respective side wall and the latch arm; and;

said side walls including inwardly recessed areas into which the latch hooks extend.

2. The electrical connector of claim 1 wherein said latch hooks have rearwardly facing latching surfaces which are angled in a rearward-inward direction.

3. The electrical connector of claim 1 wherein said dielectric housing is a one-piece unitarily molded structure with said latch arms being molded integrally therewith.

4. An electrical connector, comprising:

a dielectric housing having a forward end, a rear end and opposite side walls, the housing being adapted for mounting on a complementary support structure in a forward mounting direction;

a latch arm cantilevered and located a given distance from at least one of said side walls of the housing and extending from a fixed end of the arm in said forward mounting direction, each latch arm having a latch hook near a free end of the arm, the latch hook projecting transversely of said forward mounting direction inwardly toward the side wall of the housing;

the latch arm, the latch hook, at least one side wall and the fixed end of the arm define an opening adapted to receive and hold a portion of the complementary support structure between the side wall and the latch arm; and said at least one side wall including an inwardly recessed area into which the latch hook extends.

5. The electrical connector of claim 4 wherein said latch hook has a rearwardly facing latching surface which is angled in a rearward-inward direction.

6. The electrical connector of claim 4 wherein said dielectric housing is a one-piece unitarily molded structure with said latch arm being molded integrally therewith.

* * * * *